US005401292A

United States Patent [19]

Japka

[11] Patent Number: 5,401,292

[45] Date of Patent: Mar. 28, 1995

[54] CARBONYL IRON POWER PREMIX COMPOSITION

[75] Inventor: Joseph E. Japka, Lincoln Park, N.J.

[73] Assignee: ISP Investments Inc., Wilmington, Del.

[21] Appl. No.: 924,861

[22] Filed: Aug. 3, 1992

[51] Int. Cl.[6] ..... C22C 29/12

[52] U.S. Cl. ..... 75/233; 75/235; 75/236; 75/238; 75/246; 75/252; 75/254

[58] Field of Search ..... 75/245, 246, 252, 254, 75/255, 233, 235, 236, 238; 419/23

[56] References Cited

U.S. PATENT DOCUMENTS

| | | | |
|---|---|---|---|
| 3,481,714 | 12/1969 | Harrington et al. | 75/246 |
| 3,495,958 | 2/1970 | Talmage | 75/243 |
| 3,785,801 | 1/1974 | Benjamin | 75/240 |
| 3,992,161 | 11/1976 | Cairns et al. | 29/182.5 |
| 4,612,163 | 9/1986 | Nishio et al. | 419/68 |
| 4,721,599 | 1/1988 | Nakamura | 419/23 |
| 4,836,850 | 6/1989 | Kemp, Jr. et al. | 75/251 |
| 4,867,943 | 9/1989 | Kiyota | 419/23 |
| 4,965,039 | 10/1990 | Schultz | 264/553 |
| 5,006,164 | 4/1991 | Kiyota | 75/255 |
| 5,009,841 | 4/1991 | Bloemacher et al. | 419/23 |
| 5,015,289 | 5/1991 | Toda et al. | 75/229 |
| 5,045,512 | 9/1991 | Lange et al. | 501/96 |
| 5,067,979 | 11/1991 | Kiyota et al. | 75/243 |
| 5,141,554 | 8/1992 | Kijima | 75/246 |
| 5,147,601 | 9/1992 | Ohtsuka et al. | 419/25 |

*Primary Examiner*—Donald P. Walsh
*Assistant Examiner*—Ngoclan T. Mai
*Attorney, Agent, or Firm*—Walter Katz; Marilyn J. Maue; Joshua J. Ward

[57] ABSTRACT

A carbonyl iron powder (CIP) premix composition suitable for metal injection molding is provided herein. The composition comprises (a) CIP having a particle size in the range of about 0.2–7 microns, preferably about 0.2–5 microns, and a narrow particle size distribution; and (b) an alloying material, having a particle size in the range of about 0.02 to 5 microns, preferably about 0.03 to 3.0 microns, and a narrow particle size distribution, comparable to the CIP, and present in an amount of about 0.1–60% by weight of the composition, preferably 0.5–50%. The alloy material substantially covers the surface of the iron particles and is adhered thereto by attractive forces. Preferably the alloy material includes elemental metal powders which are smaller in particle size than the CIP.

The premix composition is prepared by intensive mixing of its powder components, e.g. by attritor milling at high speeds for an extended period of time, which reduces the particle size distributions of the powders and avoids alloy segregation during sintering.

7 Claims, 2 Drawing Sheets

CARBONYL IRON POWER PREMIX COMPOSITION

BACKGROUND OF THE INVENTION

1. Field of the Invention

This invention relates to carbonyl iron powder (CIP) premix compositions for metal injection molding (MIM), and more particularly, to improved premix compositions, and to a process for making such premix compositions which are characterized by predetermined particle sizes, and narrow particle distributions, of the respective powders therein, and which can provide sintered products having an enhanced sintered density, low porosity values and minimum alloy segregation.

2. Description of the Prior Art

CIP has been used for MIM of steel and other alloy parts since the inception of MIM technology. CIP material is advantageous for MIM processing because of its uniform, spherically-shaped, fine particles, and its highly reactive surface which provides an effective sintering reactivity. Accordingly, CIP has been a material of choice for most iron-based alloy articles made by the MIM process. However, these procedures are limited in scope at present because of the disadvantageous effect of alloy segregation, and the low sintered density and/or high porosity of the products obtained.

Accordingly, it is desired to provide new and improved CIP premix compositions, and a process for making such compositions, from which molded CIP-containing alloy products can be made commercially having advantageous physical properties including maximized sintered density, low porosity and enhanced sintered alloy uniformity.

SUMMARY OF THE INVENTION

A carbonyl iron powder (CIP) premix composition suitable for metal injection molding is provided herein. The composition comprises (a) CIP having a particle size in the range of about 0.2–7 microns, preferably about 0.2–5 microns, and a narrow particle size distribution; and (b) an alloying material, having a particle size in the range of about 0.02 to 5 microns, preferably about 0.03 to 3.0 microns, and a narrow particle size distribution, comparable to the CIP, and present in an amount of about 0.1–60% by weight of the composition, preferably 0.5–50%. The alloy material substantially covers the surface of the iron particles and is adhered thereto by attractive forces. Preferably the alloy material includes elemental metal powders which are smaller in particle size than the CIP.

The premix composition is prepared by intensive mixing of its powder components, e.g. by attritor milling at high speeds for an extended period of time, which reduces the particle size distributions of the powders and avoids alloy segregation during sintering.

IN THE DRAWINGS

DETAILED DESCRIPTION OF THE INVENTION

A. INVENTION

Figure 1:
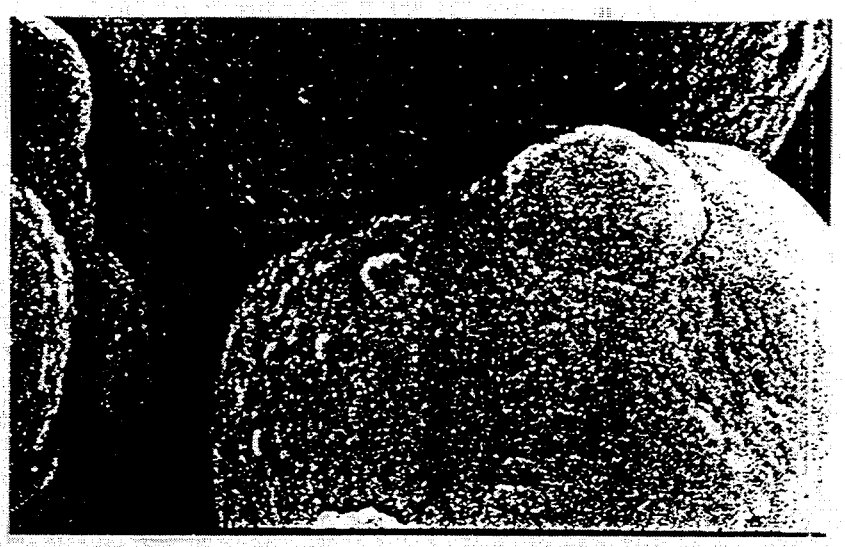
FIG. 1 is an SEM photomicrograph of substantially spherical CIP particles.

In accordance with the invention, premix compositions are prepared for MIM by intensively mixing of the CIP with a suitable alloy material to provide a premix composition of having predetermined particle sizes of the CIP and alloy components therein, and both with a narrow particle size distribution.

The premixes then are blended with a suitable binder to form a feedstock mixture, molding the feedstock into a shaped article in an injection molding machine, removing the binder to form a porous metal structure, and sintering the debound structure at progressively higher temperature in a hydrogen-containing atmosphere or in a vacuum to provide the finished sintered part.

The CIP for use in the invention are obtained from International Specialty Products having a particle size in the range of 0.2–7 microns, preferably about 0.2–5 microns.

The other powder components of the premix composition of the invention are alloying materials which are selected to provide a suitable alloy of desired composition. This other powder component generally is present in the alloy composition in an amount of about 0.1–60% by weight, preferably 0.5–50%.

A wide range of alloy materials may be used in this invention which advantageously provides the art with many usable finished alloy parts made by the MIM process. For example, such alloy materials as non-metallic elements, e.g. carbon or boron; metallic elements, e.g. nickel, molybdenum, silicon and cobalt; refractory oxides, e.g. aluminum oxide, silica, titanium oxide and aluminides; and intermetallics, e.g. iron silicide and iron carbide; and mixtures thereof, may be used herein. Preferably the alloy material includes elemental metal powders which are smaller in particle size than the CIP. Other such materials known to the art and not specifically mentioned here also may be used.

The particle sizes of the second component is about 0.02–5 microns, preferably 0.03–3 microns, and also have a narrow particle size distribution, similar to the CIP. Preferably, they are spherical (or ovodial or lenticular) in shape, too, to minimize internal friction during the MIM step, to substantially uniformly cover the surface of the CIP, and to adhere thereto by attractive forces.

The premixes of the invention are stable during the powder formulation, and do not show any evidence of segregation during ordinary handling.

As another feature of the invention, the premix composition of CIP and alloy material are prepared by intensively mixing the respective powders to enable the alloy powders to suitably cover the CIP material and to reduce the particle size distributions of both components of the premix to acceptable levels. Generally, the intensive processing step is carried out by attritor milling the components at high speeds in an inert atmosphere for an extended period of time. After such intensive processing, the particle size distribution of the alloy powder approximates that of CIP.

The attritor mill is a grinding mill containing internally agitated media, also generically referred to as a "stirred ball mill". The media may be a ceramic, a hard metal or glass spheres, which are agitated by a steel horizontal bar stirrer at varying speeds. The high power input is used directly for agitating the media, not for rotating or vibrating a large, heavy vessel in addition to the media charge. A suitable attritor mill is the commercial machine made by Union Process Attritor Company, Model 1S, which is run at 250 rpm for 2–3 hours, using a media of 14 lbs. of ¼" ceramic balls with a 10 lb. powder charge.

B. EXPERIMENTAL RESULTS

Referring now to FIG. 1, there is shown an SEM photomicrograph of particles of the CIP starting material having a substantially spherical shape. Such CIP particles are suitable for use herein to provide the premix composition of the invention.

Figure 2:
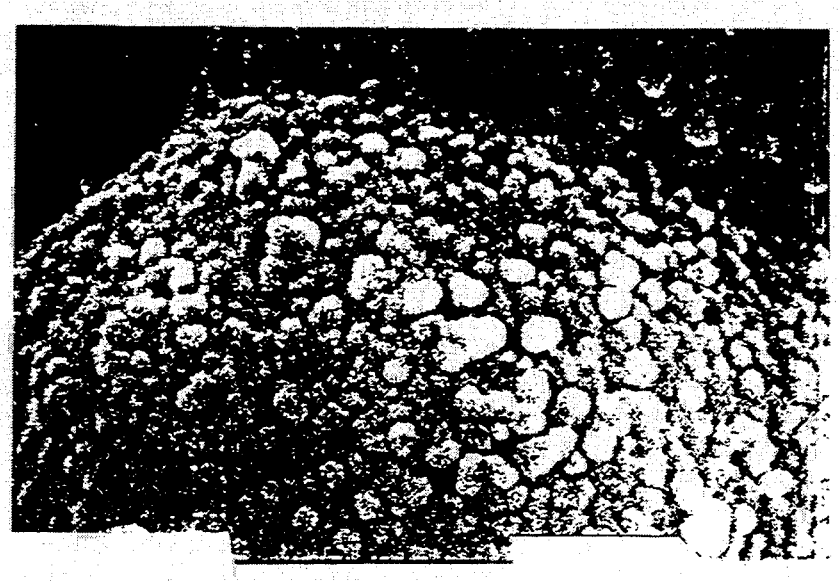
FIG. 2 is another SEM photomicrograph of the CIP particles of FIG. 1 with carbon powder deposited thereon without affecting their spherical shape.

FIG. 2 shows a similar SEM photomicrograph of these CIP particles with a second component of carbon powder uniformly deposited on the surfaces of the CIP, and adhered thereto, after attritor processing, still without affecting the spherical shape of the CIP particles.

Figure 3:
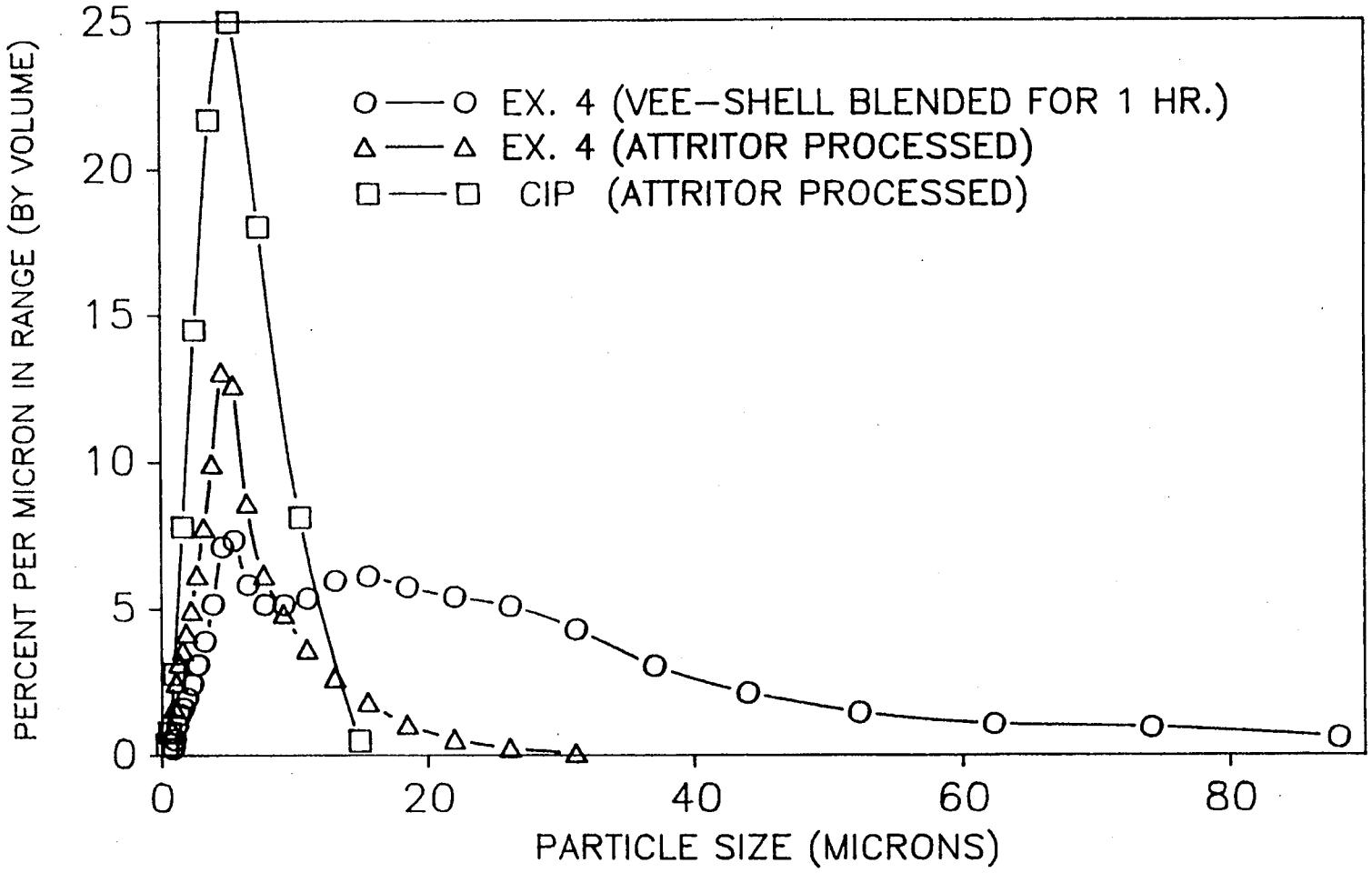
FIG. 3 is a graphical representation of (1) a typical premix composition of the invention of CIP-50% Ni formulation showing the respective particle size distributions for compositions prepared (a) mild blending and (b) intensively processed powders (attritor milling) of the CIP and Ni alloy components of the composition; and (2) of CIP itself.

FIG. 3 shows the effect of intensive processing of a CIP-50% Ni premix formulation on the particle size distribution of the premix as compared to only mild blending. Curve (1) (b) (attritor agitation) shows the resultant desired narrow particle size distribution of about 0.2–5 microns, whereas, in Curve (1) (a) (mild processing), a very wide particle size distribution is evident. Curve (2) show the narrow particle size distribution of CIP itself, which is comparable to the premix composition of Curve (1) (b).

The graphical results shown in FIG. 3 were made using a Microtrac Analyzer (Leeds and Northrop). Similar particle size and particle size distribution measurements were made by image analysis* using a Donsanto Micro Plan II System. These measurements show a further narrowing of the particle size distribution curves of FIG. 3, particularly for CIP itself and for the premix composition upon attritor mill processing.

To test the effect of the properties of the premix composition on the properties of the finished alloy parts, the premix was mixed with a binder to form a feedstock formulation.

For this purpose, a simple binder was used as the plastic filler and blended with the premix. The binder consisted of 64% paraffin, 20% polypropylene, 15% carnauba wax and 1% stearic acid. The binder ingredients were melted in a beaker at abut 200° C. and the premix powder was added to the melted binder at 120°–130° C. while mixing manually. About 62% by volume of premix powder was used to form the feedstock, and its viscosity was predetermined by addition of small amounts of binder or premix until a very stiff putty material was formed.

* Modern Developments in Powder Metallurgy, Vols. 18–21, 1988, pages 339–358

A MIM die-mold apparatus was used to form small molded bars of the feedstock dimensions: 10 cm ×1 cm ×0.5 cm. A mold chamber with a piston was filled with about 150 g of the feedstock mixture. The other end of the chamber contained a tapered extrusion die with a 4 mm opening which fit into a split aluminum die which formed the test part. The molding operation was started by loading the MIM die with the feedstock mixture and heating to about 110°–120° C. The split mold then was preheated to 35°–40° C. and fitted to the die vertically. This assembly was compressed rapidly in a mechanical hand press to form the desired molded MIM test part.

Before sintering the test MIM parts, the plastic/wax binder was removed without damage to the part. The deblending step was carried out at a temperature below any possible sintering temperature. The debinding procedure comprised the steps of placing the test parts on Fiberfax pads in a vacuum oven and evacuating to about 28–29" of Hg. The oven temperature then was raided slowly to 180° C. and held overnight, whereupon 50% of the wax binder was removed.

The parts were cooled and placed in a stainless steel boat which was loaded into a sintering furnace at room temperature.

The sintering furnace temperature then was raised to 250° C. under a nitrogen atmosphere and held for one hour. A substantial portion of the remaining binder was evaporated during this step. The furnace atmosphere was then changed to either a 100% dry hydrogen or a mixed hydrogen-nitrogen mixture and the furnace temperature was raised to 500° C. and held there for one hour. Any residual binder present was removed thereby.

The sintering cycle used for sintering the MIM premix powder articles used a typical retort furnace batch operation. A 100% dry hydrogen or a mixed hydrogen-nitrogen atmosphere was used for this work. In operation, the test parts were placed on trays and loaded into the furnace. The furnace then was heated to temperature. The sintering step was carried out in a quartz tube furnace with the parts to be sintered centered in the hot zone. The furnace was heated to the final holding temperature in 2 to 2½ hours, and held for one hour. Following the sintering, the furnace power was shut off and the temperature was lowered to 750°–800° C. over the course of one hour. The parts tray was then pushed to the cold zone and allowed to cool to room temperature in 20–30 minutes. After a change to a 100% nitrogen atmosphere, the parts tray was removed from the furnace.

The Table below shows the results of preparation of the CIP premix composition of the invention by intensive attritor milling at high speeds in an inert atmosphere for an extended period of time, followed feedstock formulation, debinding and sintering test parts by the procedures given above.

TABLE

| | EXAMPLES* | | | | | |
|---|---|---|---|---|---|---|
| | CIP Premix | | Alloying Material | | Sintered Product | |
| | Particle Composition | | Particle | Amount | Sintered Density | Percent of Theor. |
| Ex. No. | Iron Size | Additive | Size | (%) | (g/cc) | Density (Porosity) |
| 1 | 3–5 | — | — | — | 7.60 | 97.2 |
| 2 | 3–5 | C | 0.05 | 0.8 | 7.63 | 97.7 |
| 3 | 3–5 | Ni | 2 | 2 | 7.70 | 97.8 |
| | | Mo | 4 | 0.5 | | |
| 4 | 3–5 | Ni | 2 | 50 | 7.96 | 94.9 |

TABLE-continued

| | EXAMPLES* | | | | | |
|---|---|---|---|---|---|---|
| | CIP Premix | | Alloying Material | | Sintered Product | |
| | Particle Composition | | Particle | Amount | Sintered Density | Percent of Theor. |
| Ex. No. | Iron Size | Additive | Size | (%) | (g/cc) | Density (Porosity) |
| 5 | 3–5 | Co | 3 | 40 | 7.77 | 93.8 |

*Examples 4 and 5 were sintered in 100% $H_2$;
Example 1–3 were sintered in 25% $H_2$–75% $N_2$ The results in the Table above were obtained with CIP premix compositions which were observed to be stable formulations, and which did not show any evidence of alloy particle segregation during ordinary handling. The particle size distribution of the premix was similar to standard CIP, as measured by a Leeds and Northrop by Microtrac® laser-light scattering instrument.

While the invention has been described with particular reference to certain embodiments thereof, it will be understood that changes and modifications may be made which are within the skill of the art. Accordingly, it is intended to be bound only by the following claims, in which:

What is claimed is:

1. A carbonyl iron powder premix composition suitable for metal injection molding consisting essentially of:

(a) carbonyl iron powder particles substantially spherical in shape having a particle size of about 0.2–7 microns and a narrow particle size distribution, and (b) 0.1–50% by weight of the composition of alloying powders selected from the group consisting of carbon, boron, nickel, cobalt, molybdenum, aluminum oxide, silica, titanium oxide, iron silicide, iron carbide, aluminide, and mixtures thereof uniformly covering substantially all the surfaces of the spherical carbonyl iron powder particles and adhered thereto by attractive forces, said alloying powders having a particle size of about 0.02–5 microns, and a particle size distribution substantially the same as the carbonyl iron powder.

2. A carbonyl iron powder premix composition according to claim I which is made by intensive attritor mill processing of the premix powders.

3. A carbonyl iron powder premix composition according to claim 2 which is made by intensive attritor milling of the premix powders in an inert atmosphere for an extended period of time.

4. A carbonyl iron powder premix composition according to claim 3 in which said attritor milling is carried out for 2–3 hours at 250 rpm.

5. A carbonyl iron powder premix composition according to claim 1 in which (a) has a particle size of 0.2–5 microns, and (b) has a substantially spherical, ovodial or lenticular particle size of 0.03 –3 microns, and is present in an amount of 0.2–50% by weight of the composition.

6. A carbonyl iron powder feedstock formulation comprising the carbonyl iron powder premix composition of claim 1 and a binder.

7. A sintered carbonyl iron powder alloy article having a sintered density of about 7.60 to 7.96 g/cc and about 93.8 to 97.8% of the theoretical density substantially without alloy segregation made by sintering the molded and debound article of the feedstock of claim 6.

* * * * *